US008763295B2

(12) United States Patent
Trimble

(10) Patent No.: US 8,763,295 B2
(45) Date of Patent: Jul. 1, 2014

(54) FIREARM WITH A ROTATING PISTOL

(71) Applicant: James R Trimble, Eureka, CA (US)

(72) Inventor: James R Trimble, Eureka, CA (US)

( * ) Notice: Subject to any disclaimer, the term of this patent is extended or adjusted under 35 U.S.C. 154(b) by 0 days.

(21) Appl. No.: 13/729,499

(22) Filed: Dec. 28, 2012

(65) Prior Publication Data

US 2013/0239453 A1 Sep. 19, 2013

Related U.S. Application Data

(60) Provisional application No. 61/612,101, filed on Mar. 16, 2012.

(51) Int. Cl.

| | |
|---|---|
| ***F41C 27/18*** | (2006.01) |
| ***F41A 19/08*** | (2006.01) |
| ***F41C 23/12*** | (2006.01) |
| ***F41A 23/02*** | (2006.01) |
| ***F41A 11/02*** | (2006.01) |
| ***F41C 23/04*** | (2006.01) |
| ***F41C 27/00*** | (2006.01) |

(52) U.S. Cl.

CPC ..... *F41A 23/02* (2013.01); *F41A 11/02* (2013.01); *F41C 23/04* (2013.01); *F41C 27/00* (2013.01); *F41C 27/18* (2013.01); *F41A 19/08* (2013.01); *F41C 23/12* (2013.01)

USPC ..... 42/72

(58) Field of Classification Search

USPC ..... 42/72, 71.01, 77, 71.02, 73, 85, 105, 42/90; 89/37.04

See application file for complete search history.

(56) References Cited

U.S. PATENT DOCUMENTS

| | | | | |
|---|---|---|---|---|
| 3,369,316 | A * | 2/1968 | Miller | 42/72 |
| 5,641,102 | A * | 6/1997 | Hellweg | 224/198 |
| 7,322,142 | B1 * | 1/2008 | Leung | 42/71.01 |
| 7,398,616 | B1 * | 7/2008 | Weir | 42/73 |
| 7,437,847 | B1 * | 10/2008 | Mabry | 42/71.02 |
| 7,552,557 | B1 * | 6/2009 | Mabry | 42/72 |
| 8,281,512 | B2 * | 10/2012 | Lara | 42/85 |
| 2005/0188593 | A1 * | 9/2005 | Cerovic et al. | 42/77 |
| 2011/0225865 | A1 * | 9/2011 | Williams | 42/90 |

* cited by examiner

*Primary Examiner* — Reginald Tillman, Jr.

(57) ABSTRACT

A weapon includes a primary firearm and a secondary firearm. The secondary firearm is attached to the primary firearm such that it may be used independently from or in conjunction with the primary firearm. The secondary firearm can be rotated in relation to the primary firearm, allowing two targets to be shot simultaneously. The secondary firearm is rotated by a swivel control built into the primary firearm. A camera system outputs video feed to included displays, allowing a user to view around corners without being exposed to danger. A communications module allows the weapon to interface with external devices, enabling third parties to control the secondary firearm. In addition to the primary and secondary firearm there are mounting points for accessory weapons, such as an electroshock weapon and knife. As with the secondary firearm, these too can be detached to be used independently.

18 Claims, 8 Drawing Sheets

FIREARM WITH A ROTATING PISTOL

The current application claims a priority to the U.S. Provisional Patent application Ser. No. 61/612,101 filed on Mar. 16, 2012.

FIELD OF THE INVENTION

The present invention relates generally to an apparatus for a firearm. The present invention is an apparatus that includes a primary firearm with an attached rotatable secondary firearm. Other attachments are included to increase the effectiveness of the primary firearm and the overall present invention. More specifically, the present invention is an apparatus for a firearm with a mounted pivoting pistol on a long barreled gun.

BACKGROUND OF THE INVENTION

In the past there has not been a way for a single soldier to fire at two different targets located in different directions at one time, short of using two separate weapons. While in a hostile environment, the soldier would benefit from a firearm with which he/she can shoot around a corner without exposing him/herself and at the same time able to cover his/her front with another weapon. While there are firearms with a variety of attachments, these attachments are generally fixed and do not allow a user to aim each weapon in a separate direction. In addition, commonly only a single part of the firearm may be utilized at any one time. Though there are weapons that are capable of firing around an obstacle they often have a limited angle of coverage. At most, such weapons can cover a 90 degree spread from the default firing alignment. In addition, even while many existing solutions provide some sort of display, the integration and capabilities of the display are not perfectly suited for a weapon with a large angle of motion.

It is therefore an object of the present invention to create an apparatus of a firearm that has a pivoting pistol below a long barreled gun with a liquid crystal display (LCD) screen so the soldier can fire around a corner or edge wall without exposing his/her body and at the same time be aiming at a different target with the same weapon. It is a further object of the present invention to be in communication and controllable by external devices, improving overall awareness of a user of the present invention.

DETAIL DESCRIPTIONS OF THE INVENTION

Figure 1:
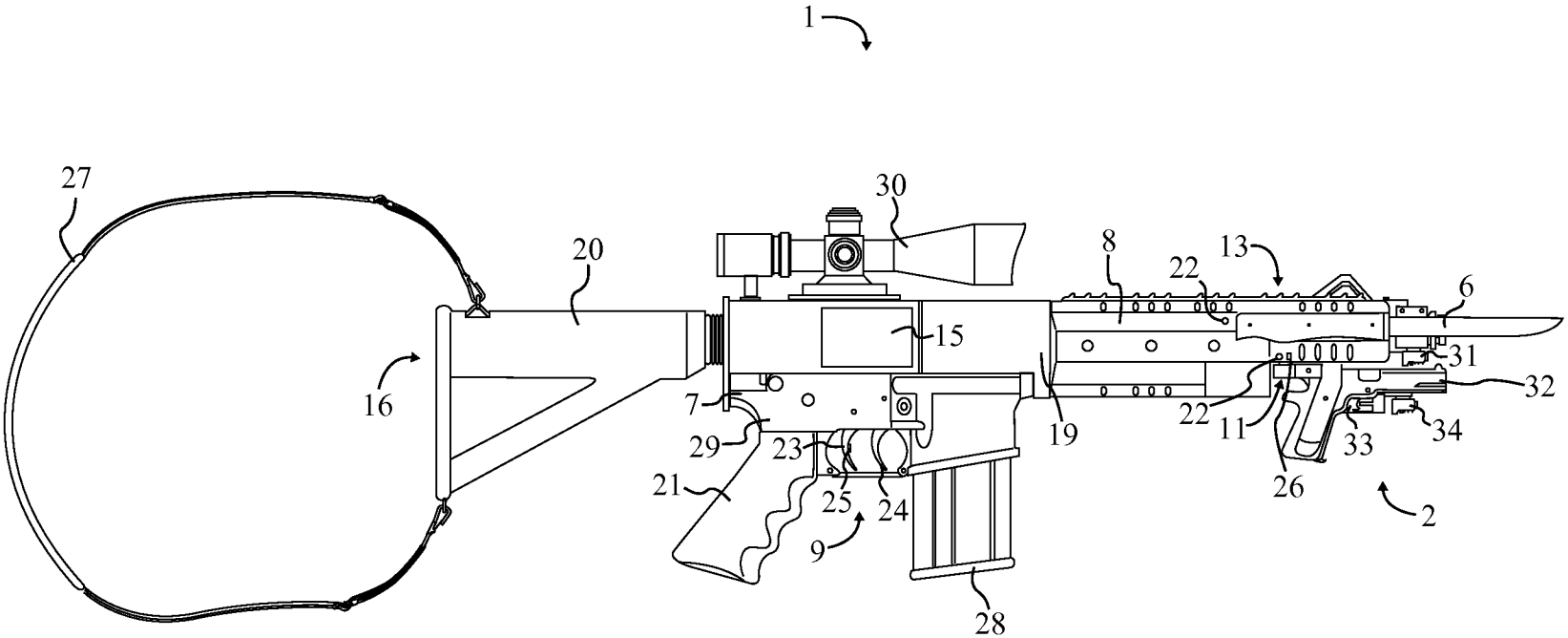
FIG. 1 is a left side view of the present invention.

All illustrations of the drawings are for the purpose of describing selected versions of the present invention and are not intended to limit the scope of the present invention.

The present invention is a battery operated and computerized firearm that incorporates two weapons into a single apparatus. In the preferred embodiment, the two weapons are individual firearms, referred to as the primary firearm 1 and secondary firearm 2. Shown in FIG. 1-FIG. 6, the present invention comprises a primary firearm 1, a secondary firearm 2, a communications module 3, a battery 4, an electroshock weapon 5, and a knife 6. The secondary firearm 2 is removably attached to the primary firearm 1, and is capable of rotating to face a different angle than the primary firearm 1. The secondary firearm 2 can rotate 150 degrees in either direction from parallel with the primary firearm 1, for a total of 300 degrees of rotation. This allows the secondary firearm 2 to point in a partially rearwards direction. In combination with the primary firearm 1, the secondary firearm 2 allows a user to fire at two targets simultaneously. The communications module 3 allows the present invention to transmit relevant data to other devices, while the battery 4 provides power for the communications module 3 and other internal components. The electroshock weapon 5 and the knife 6 connect to the front of the primary invention and can be detached to be used independently. It is also possible for the computerized aspect of the present invention to be omitted, resulting in a simpler and less expensive primary firearm 1 with an attached rotatable secondary firearm 2.

Figure 2:
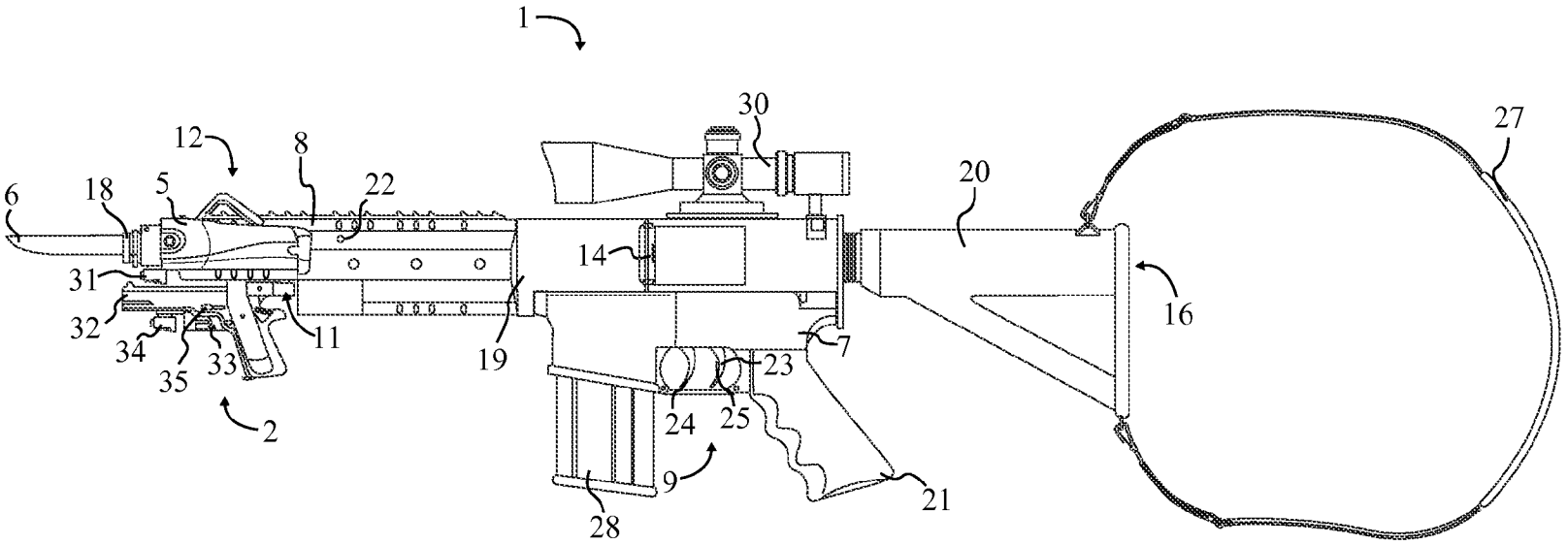
FIG. 2 is a right side view of the present invention.

The primary firearm 1 comprises a receiver 7, a high powered primary barrel 8, a trigger 9, a swivel control 10, a first mounting point 11, a second mounting point 12, a third mounting point 13, a first display 14, a second display 15, a stock 16, and a set of accessories 17. These components are illustrated in FIG. 1 and FIG. 2. The primary barrel 8 comprises a muzzle 18, located at the front end of the barrel. The stock 16 comprises a forend 19, a telescoping shoulder rest 20, and a rear grip 21. The stock 16 allows a user to hold the primary firearm 1, with the barrel being connected to the forend 19. Connected to the barrel, forming a middle part of the stock 16, is the rear grip 21. Behind the rear grip 21 is the telescoping shoulder rest 20. The forend 19 and the rear grip 21 allow a user to hold the primary firearm 1, with one hand grasping the rear grip 21 and another hand supporting the forend 19. The telescoping shoulder allows a user to brace the primary firearm 1 against their torso. The first mounting point 11, second mounting point 12, and third mounting point 13 each include a quick-release mechanism 22. This quick-release mechanism allows a user to easily and quickly remove an attached device, such as the secondary firearm 2, electroshock weapon 5, or knife 6, from the present invention.

Figure 3:
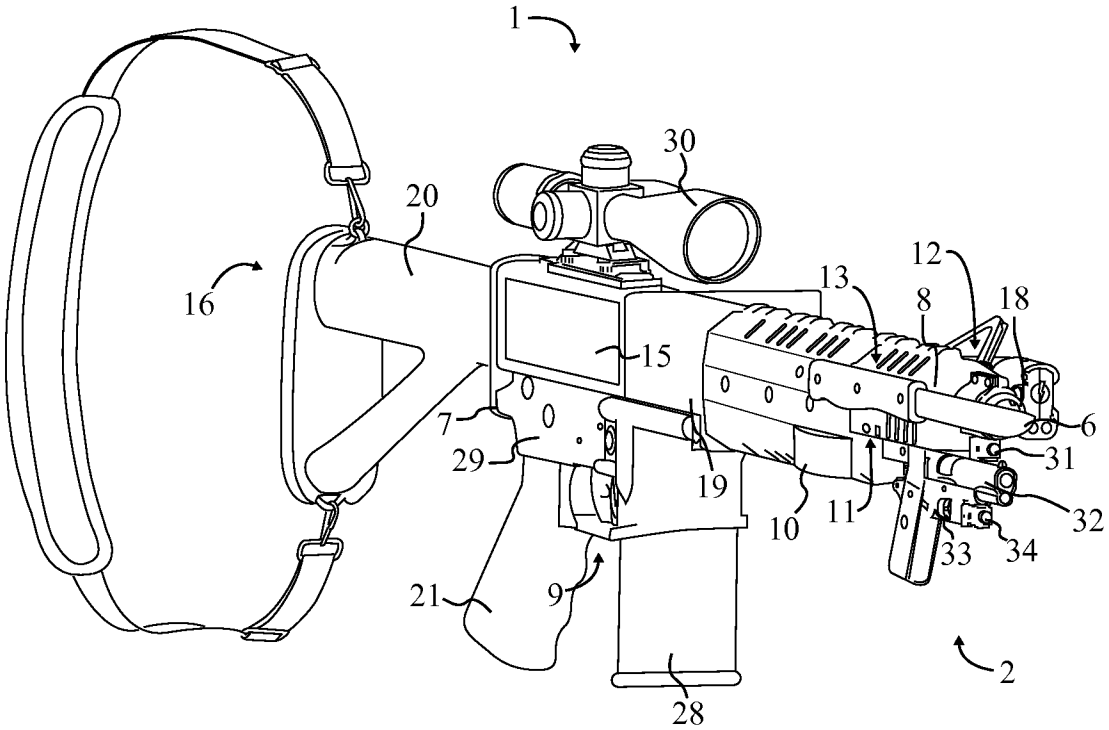
FIG. 3 is a front-left perspective view of the present invention.
Figure 4:
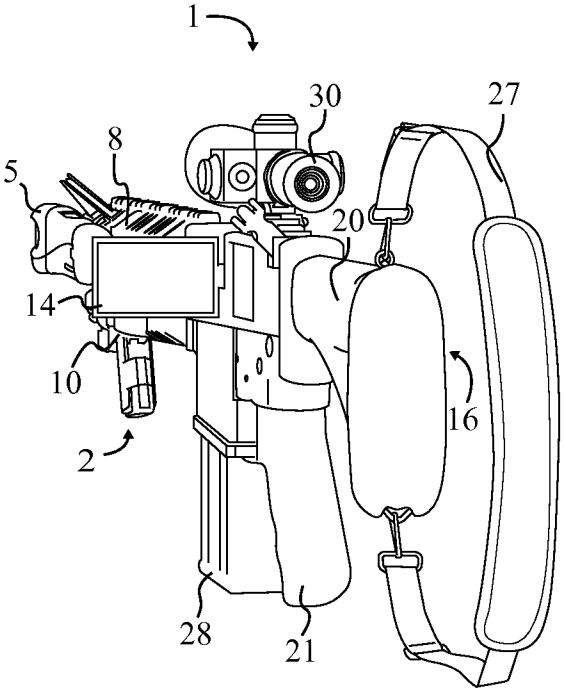
FIG. 4 is a rear-right perspective view of the present invention.
Figure 5:
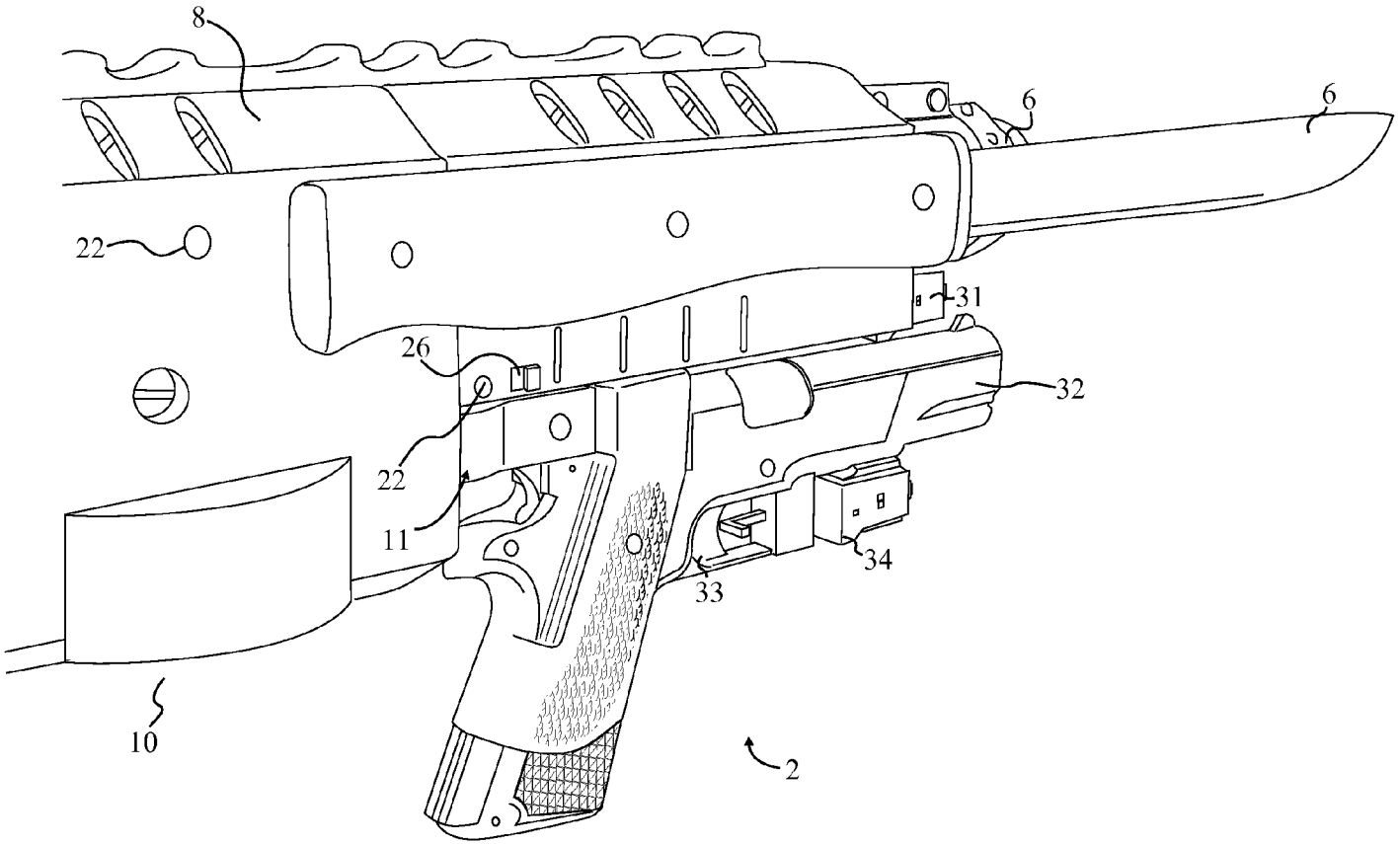
FIG. 5 is a left perspective view of the secondary firearm of the present invention.
Figure 6:
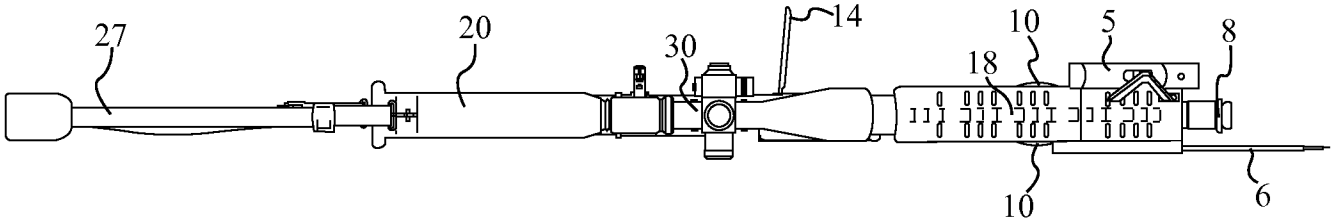
FIG. 6 is a top view of the present invention.

The trigger 9 is connected to both the stock 16 and the receiver 7, next to the rear grip 21. The trigger 9 enables a user to easily fire the primary firearm 1 with the same hand that holds the rear grip 21, as seen in FIG. 1 and FIG. 2. The trigger 9 comprises a first trigger 23, a second trigger 24, and an electronic trigger 25, with the first trigger 23 being located behind the second trigger 24. The first trigger 23 (the rear trigger) is used to fire the primary firearm 1 while the second trigger 24 (the front trigger) is used to fire the secondary firearm 2. The first trigger 23 and second trigger 24 are aligned with each other, allowing a user to quickly switch between firing the primary firearm 1 and the secondary firearm 2. The setup of the first and second trigger 24 also allow a user to fire the primary firearm 1 and secondary firearm 2 simultaneously. The electronic trigger 25 is attached to the first trigger 23, being clamped in place. The electronic trigger 25 is an extra sensitive trigger 9 that reduces the amount of pressure required to fire the primary firearm 1; in addition, a user can adjust the sensitivity of the electronic trigger 25 to suit their personal preferences. The electronic trigger 25 is removable, allowing a user to attach the electronic trigger to the second trigger 24, secondary trigger 33, or to be omitted if so desired. The swivel control 10, as seen in FIG. 3-FIG. 5, is located midway along the length of the forend 19, with the swivel control 10 being accessible from each side of the forend 19. The main body of the swivel control 10 is housed within the forend 19, but since part of the swivel control 10 extends past the sides of the forend 19, it can still be controlled by a user. Located adjacent to the swivel control 10, at the front half of the forend 19, is the first mounting point 11. The first mounting point 11 is connected to the underside of the forend 19, and serves as an attachment point for the secondary firearm 2. The first mounting point 11 is also connected to the swivel control 10, allowing a user to rotate the secondary firearm 2 by simply operating the swivel control 10. Alternatively, a user can rotate the secondary firearm 2 by hand, although this will still cause the swivel control 10 to rotate as the mounting point remains connected to the swivel control 10. The first mounting point 11 also includes a locking mechanism 26, such as a pin, that prevents the first mounting point 11 (and any attached items, such as the secondary firearm 2) from rotating. This allows a user to steady the secondary firearm 2 and prevent undesired movements. The pistol defaults to being locked in a forward facing position. The second mounting point 12, like the swivel control 10, is connected to the side of the forend 19. The second mounting point 12 is positioned adjacent to the muzzle 18, and serves as an attachment point for the electroshock weapon 5. Similar to the second mounting point 12, the third mounting point 13 is connected to the side of the forend 19, on the side opposite where the second mounting point 12 is connected. This third mounting point 13 serves as an attachment point for the knife 6.

To provide additional stability to the secondary firearm 2, another embodiment of the present invention incorporates a brace running from the swivel control 10 to the secondary firearm 2. This brace is bolted into the swivel control 10, helping to absorb recoil from firing the secondary firearm 2. The brace extends from the swivel control 10 to the secondary firearm 2, where a notch receives the grip of the secondary firearm 2. This addition is especially useful when using high-powered secondary firearms 2, where recoil may be more difficult to control than with low-power secondary firearms 2.

The first display 14, as shown in FIG. 4, is connected by a hinge to the side of the primary firearm 1. The hinge allows the first display 14 to rotate between an open and closed position. In a closed position the first display 14 is folded flat against the primary firearm 1, allowing a user an unobstructed view on that side of the primary firearm 1. In an open position, the first display 14 is rotated up to 180 degrees; in this open position the first display 14 is oriented so that it faces a user holding the primary firearm 1. On the opposite side of the primary firearm 1 is the fixed second display 15; it cannot be moved, either laterally or about an axis. The second display 15 is oriented so that its length is parallel to the primary barrel 8. Thus, when viewing the side of the primary firearm 1 (for example, if using the present invention to shoot around a corner), the second display 15 will be fully visible. A protective housing is provided for both the first display 14 and the second display 15.

Figure 7:
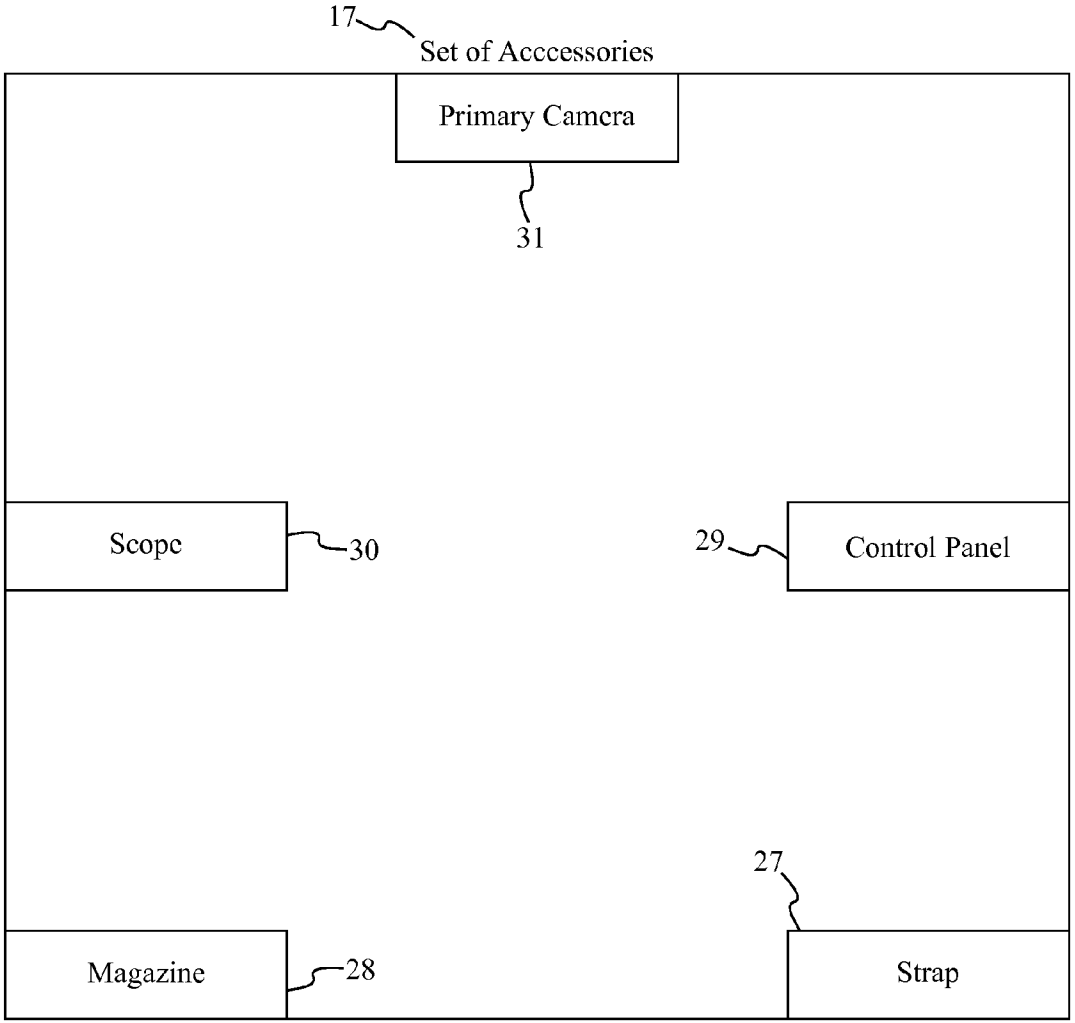
FIG. 7 is a diagram showing the accessories of the present invention.

As outlined in FIG. 7, the set of accessories 17 comprises a strap 27, a magazine 28, a control panel 29, a scope 30, and a primary camera 31. The strap 27 connects to the rear end of the stock 16, adjacent to the telescoping shoulder rest 20, allowing a user to sling the strap 27 over their shoulder and make the present invention easier to carry or conceal. The magazine 28 is of a straight design and traverses into the primary firearm 1 and connects to the receiver 7, providing ammunition to the present invention. The control panel 29 is recessed into the primary firearm 1 and permits a user to interact with various components, including the displays and cameras. The scope 30 is positioned on top of the primary firearm 1, connected to the receiver 7. The scope 30 is aligned with the primary barrel 8 and provides assistance with aiming. The primary camera 31 is connected to the primary firearm 1 just below the muzzle 18, with the path of a fired bullet being directly above the primary camera 31. The primary camera 31 provides a view from the front of the primary firearm 1, displaying images and live video to the first display 14 and second display 15. This primary camera 31 allows a user to point the primary firearm 1 around corners or other obstacles and observe an area with being exposed to hazards, such as coming under fire from enemy combatants. The video output can be viewed on the first display 14 or the second display 15, depending on the orientation of a user in relation to the primary firearm 1.

As depicted in FIG. 5, the secondary firearm 2 comprises a secondary barrel 32, a secondary trigger 33, a secondary camera 34, and a cocking rod 35. The secondary firearm 2 attaches to the first mounting point 11. It has an axis of rotation perpendicular to the primary barrel 8 and traversing through a grip of the secondary firearm 2, such that the secondary barrel 32 rotates on a plane parallel to that of the primary barrel 8. The secondary trigger 33 is connected to the grip of the secondary firearm 2, and allows a user to fire the secondary firearm 2 as a standalone weapon, used separately from the primary firearm 1. As with the primary firearm 1, the secondary camera 34 is positioned just below the muzzle 18 of the primary firearm 1. When the secondary firearm 2 is attached to the primary firearm 1, the secondary camera 34 provides a view from the secondary firearm's 2 point of perspective. The view from the secondary camera 34 is output to the first display 14 and the second display 15, allowing a user to use the secondary camera 34 to view areas that the primary camera 31 might not be able to see. This is accomplished by rotating the secondary camera 34, providing a greater range of motion than found in the primary camera 31 alone. Rotating the secondary camera 34 in this manner could allow a user to see around an edge wall. This is done by rotating the secondary firearm 2 to be perpendicular to the primary firearm 1, then holding the primary firearm 1 so that it extends past an edge wall. Illustrated in FIG. 1, the cocking rod 35 is perpendicular to the secondary barrel 32, extending to one side of the secondary weapon. The cocking rod 35 provides a handle that can easily be used to cock the secondary weapon, which otherwise could prove difficult in the confined space of the present invention. To fire the secondary firearm 2 from the main trigger 9, an L-shaped pin is included at the secondary trigger 33. When remotely activated, such as by the main trigger 9, this L-shaped pin extends to press the secondary trigger 33 and fire the secondary firearm 2. The L-shaped pin rotates 90 degrees, allowing the pin to be moved out of the trigger guard if a user chooses to manually operate the secondary firearm 2; in such a scenario, leaving the L-shaped pin in position would interfere with triggering the secondary firearm 2.

Figure 8:
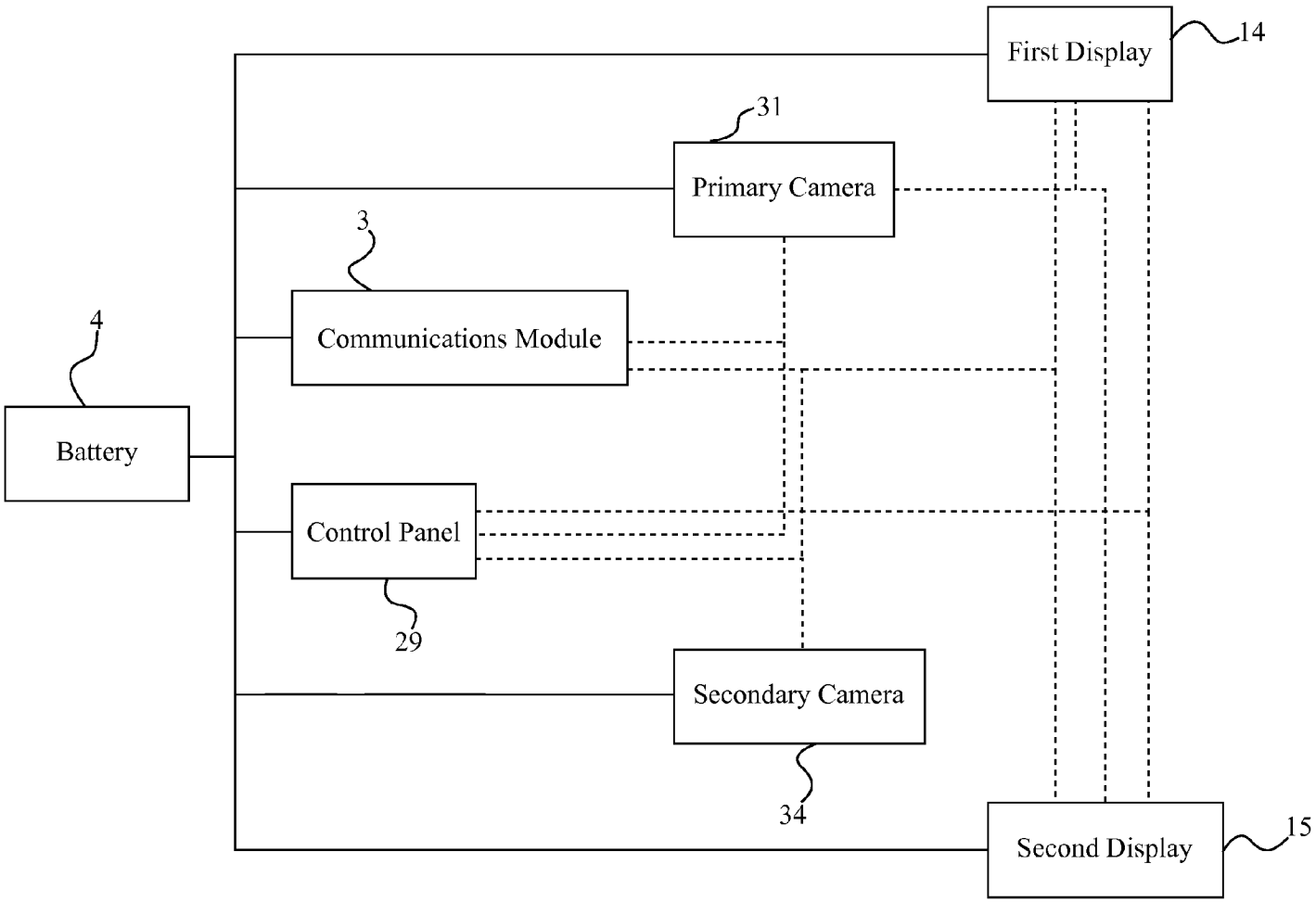
FIG. 8 is a diagram showing the electrical and electronic relations of the present invention.

The battery 4 provides power to the electronic components of the present invention, while the communications module 3 allows transmission of data to other devices, both of which are illustrated in FIG. 8. Preferably located in the trigger, the battery 4 is wired to provide power to integrated electrical components, including the first display 14, the second display 15, the control panel 29, the primary camera 31, the secondary camera 34, and the electronic trigger 25. The communications module 3 sends and receives information from the same electronic components that the battery 4 powers, which enables the present invention to interact with properly equipped external devices.

The electroshock weapon 5 and the knife 6 are attached to the second mounting point 12 and third mounting point 13, respectively, like seen in FIG. 1-FIG. 6. The electroshock weapon 5 and knife 6 provide additional capabilities to a user of the present invention, offering non-lethal or close combat options. In addition, since the electroshock weapon 5 and knife 6 can be removed from the primary firearm 1, they can be used independently. The secondary firearm 2 can be removed and used independent of the primary firearm 1 in the same manner. This can prove advantageous when a non-lethal or close combat weapon is needed without having mobility being restricted by the primary firearm 1. That is, the secondary firearm 2, electroshock weapon 5, and knife 6 are all easier to wield and operate individually rather than when attached to the primary firearm 1. The quick-release mechanisms incorporated into the first mounting point 11, second mounting point 12, and third mounting point 13 make detaching the secondary firearm 2, electroshock weapon 5, and knife 6 a quick and easy task.

In the preferred embodiment of the present invention many components have specific or additional features. The overall construction of the primary firearm 1 incorporates a carbon fiber, or any other suitable metal, shell with vent holes. With regards to the stock 16, the telescoping shoulder is split into two sections, with a rear section sleeving into a front section, usually by means of a matching track and rail. This allows a user to adjust the length of the telescoping shoulder rest 20 as desired. The telescoping shoulder rest 20 preferably includes a hinge which allows the telescoping shoulder rest 20 to fold for compact storage, with the telescoping shoulder rest 20 being folded 180 degrees to rest adjacent and besides the receiver 7 section of the primary firearm 1.

The first display 14 and the second display 15 each can receive and display feeds from the primary camera 31 and secondary camera 34. The first display 14 and second display 15 can provide various levels of zoomed views depending on the zoom levels offered by the primary camera 31 and secondary camera 34. In addition, the first display 14 and second display 15 can provide split screen viewing, showing images from both the primary camera 31 and the secondary camera 34. This allows, for example, a user to switch the first display 14 to show two targets, one viewed from the primary camera 31 and the other viewed from the secondary camera 34. In addition to video feeds from the primary camera 31 and secondary camera 34, the first display 14 and second display 15 can output additional information, such as ammunition levels and the angle of the secondary firearm 2 in relation to the primary firearm 1.

The strap 27 preferably includes a padded section, making the present invention more comfortable to carry when the strap 27 is slung over a user's shoulder. The strap 27 enables a user to conceal the present invention by hiding it beneath a coat, with the strap 27 resting against a shoulder and the primary firearm 1 being held between a user's body and arm. The secondary firearm 2 is secured to the first mounting point 11 by a rotatable receiver 7, which is mechanically connected (such as by a chain and gear system) to the swivel control 10. This enables a user to rotate the secondary fire arm by rotating the swivel control 10. The swivel control 10 rotates horizontally, with the axis of rotation being perpendicular to the length of the primary barrel 8 and roughly parallel to the rear grip 21. The primary camera 31 and secondary camera 34, as well as the second mounting point 12 and third mounting point 13, are properly distanced from the primary barrel 8 (or secondary barrel 32, in the case of the secondary camera 34) such that muzzle 18 blasts are not affected. The distancing of said components also protects against potential damage resulting from being too close to the muzzle 18 blast.

The primary firearm 1 and secondary firearm 2 each preferably include a safety to prevent accidental weapon discharges. The primary firearm 1 is preferably a rifle or assault rifle, while the knife 6 is preferably a switchblade or spring-based sliding knife 6, allowing the knife 6 blade to quickly be deployed for use. The primary camera 31 and secondary camera 34 are capable of alternate viewing modes, including night vision and infrared vision, although the primary camera 31 and secondary camera 34 default to an off state until a user opts to turn them on. In addition, the primary camera 31 and secondary camera 34 include removable storage devices. These removable storage devices can be used to record pictures and video taken from the primary camera 31 and secondary camera 34. If a user wants to view the stored data on another interface, such as a portable laptop computer, the removable storage devices can be taken out of the primary camera 31 and secondary camera 34 and inserting into the portable laptop computer. In this manner recorded data is can be viewed on a large number of other devices. While the listed components have favored implementations, other embodiments can implement variant or optional components.

While the secondary firearm 2 is preferably a pistol, in other embodiments the secondary firearm 2 can take the form of a barrel without a grip or any type of projectile weapon, such as a grenade launcher. If a grip is not used, then the secondary trigger 33 would be omitted and the secondary weapon would be fully controlled through the trigger 9 and control panel 29 of the primary firearm 1. The electroshock weapon 5 is preferably a ranged implement such as the Taser™ that fires wires which carry current from the weapon to a target.

In other embodiments the swivel control 10 can be integrated into the control panel 29; rather than manually turning the swivel control 10, an interface on the control panel 29 could be operated to send electronic signals to the swivel mechanism for the secondary firearm 2, activating a motor to rotate the secondary firearm 2. This allows a user to rotate the secondary firearm 2 with the simple push of a button. The swivel control 10 may also be disengaged, allowing a user to manually rotate the secondary firearm 2. These buttons would be positioned adjacent to the trigger 9, making them easily accessible to a user, within easy reach of the digits of the trigger hand.

In addition to the scope 30, the sighting mechanisms can include a laser sight and an iron sight. The laser sight and iron sight are attached atop the primary firearm 1, adjacent to the scope 30. Like the scope 30, the iron sight and laser sight should be aligned to be parallel to the primary barrel 8 to assist with aiming. The iron sight provides a sighting mechanism that can be used even if battery 4 power runs out, providing a backup option to the other targeting methods. Of course, adjustment could be made to the iron sight or laser sight if desired, perhaps to account for standard conditions (e.g. a typical range of engagement) that a user might face. It is also possible to include a sighting mechanism for the secondary firearm 2, though care would need to be taken to assure the sighting mechanism does not interfere with the first mounting point 11.

The telescoping shoulder rest 20 has the option of including a shock resistant feature, such as an air shock recoil reduction system, designed to buffer a user against recoil from firing the primary firearm 1 and secondary firearm 2.

The air shock recoil reduction system allows a user to set and lock a pressure per their preference. The recoil reduction system can employ various energy damping methods or materials to reduce the impact of firing the primary firearm 1 and secondary firearm 2. For example, the air shock recoil system could be spring-based, gas-based, or any other recoil method deemed useful.

Other variations and subcomponents of the present invention relate to the receiver 7, stock 16, and firing mechanisms. Specifically, a shell ejection port is included so that empty casings can be automatically discarded from the primary firearm 1. The magazines used can be selected from a variety of options, such as box magazines. The stock 16 can include a front grip, opposite the rear grip 21, although the secondary firearm 2 can be used as a front grip while attached to the primary firearm 1. Additionally, though the preferred embodiment describes the electronic trigger 25 being attached to the first trigger 23, an optional second electronic trigger 25 could be attached to the second trigger 24. In either case the electronic trigger 25 activates an electronic firing system, reducing the pressure required to fire a shot.

The components of the present invention allow it to be used in conjunction with accessories 17 and external devices. A suitcase is designed for the present invention to store subcomponents, such as the primary firearm 1, secondary firearm 2, electroshock weapon 5, and knife 6. A headset can be synchronized to the present invention, using wireless communications to receive data. Additionally, an external control system, such as in a van, can be wirelessly connected to the present invention, allowing a third party to access some features of the present invention.

The suitcase includes multiple compartments for components and accessories 17 of the present invention. The suitcase is preferably of a thin, low-profile construction and is made to be airtight. In addition to a main compartment to house the primary firearm 1 and attached secondary firearm 2, there are individual compartments for the electroshock weapon 5, the knife 6, extra ammunition, and miscellaneous personal items. The headset can be placed in the main compartment alongside the present invention.

The headset includes a heads-up display, which is wirelessly connected to the communications module 3 of the present invention. The heads-up display receives information from the communications module 3, including video feeds from the primary camera 31 and secondary camera 34. Built in sight shields which can be flipped up or down are also integrated into the heads-up display. The heads-up display can be operated by handgrips built into either side of the heads-up display. The heads-up display can also be controlled by the control panel 29 of the primary firearm 1, which can send instruction through the communications module 3 to either lower or raise the sight shields. Thus, when a user wears the heads-up display while operating the present invention, views from the primary and secondary camera 34 can easily be seen without the need to focus on the first display 14 or second display 15.

The external control system, like the headset is wirelessly connected to the communications module 3. Not only is the external control system capable of receiving video feeds from the primary camera 31 and secondary camera 34, it is also capable of sending instructions to the present invention. For example, an operator of the external control system could see a target appear on the secondary camera 34, instruct the swivel control 10 to rotate the secondary firearm 2 to be pointing at the target, and fire the secondary firearm 2 by simply pressing a button. The instructions are all communicated wirelessly through the communications module 3. The primary benefits of the external control system are extra pairs of eyes to watch feeds from the primary camera 31 and secondary camera 34, providing a better chance to notice potential hazards that might escape the attention of a user of the present invention. If and when necessary, the external control system allows third parties to take control of the secondary firearm 2, perhaps acting before a user could, or alternatively allowing the present invention to fully engage two different targets simultaneously.

While the present invention is usable in conjunction with the aforementioned accessories and external devices, the present invention is also usable as a standalone independent device. The function of the present invention remains the same with or without the inclusion of said accessories and external devices.

Although the invention has been explained in relation to its preferred embodiment, it is to be understood that many other possible modifications and variations can be made without departing from the spirit and scope of the invention as hereinafter claimed.

What is claimed is:

1. A firearm with a rotating pistol comprises, a primary firearm;

the primary firearm comprises a receiver, a primary barrel, a trigger, a swivel control, a first mounting point, a second mounting point, a third mounting point, a first display, a second display, a stock, and a set of accessories;

the primary barrel comprises a muzzle;

the stock comprises a forend, a telescoping shoulder rest, and a rear grip, wherein the telescoping shoulder rest is padded;

the first mounting point, the second mounting point, and the third mounting point each comprise a quick-release mechanism;

a secondary firearm;

the secondary firearm comprises a secondary barrel and a secondary trigger;

a communications module;

a battery;

an electroshock weapon;

a knife;

the primary barrel being positioned atop and connected to the forend;

the secondary firearm being rotatably attached to the first mounting point;

the swivel control being housed within the forend between the muzzle and the rear grip, wherein the swivel control is exposed on each side of the forend;

the first mounting point further comprises a locking mechanism;

the first mounting point being positioned below and connected to the forend adjacent to the swivel control;

the second mounting point being positioned on and connected to the primary firearm adjacent to the muzzle;

the third mounting point being positioned on and connected to the primary firearm adjacent to the second mounting point;

the electroshock weapon being attached to the second mounting point; and the knife being attached to the third mounting point.

2. The firearm with a rotating pistol as claimed in claim 1 comprises, the forend being connected to the rear grip opposite the telescoping shoulder rest;

the telescoping shoulder rest being rotatably connected to the rear grip;

the receiver being positioned adjacent to the primary barrel and the rear grip; and the receiver being connected to the trigger and the primary barrel.

3. The firearm with a rotating pistol as claimed in claim 1 comprises, the trigger comprises a first trigger, a second trigger, and an electronic trigger;

the trigger being connected to the stock adjacent to the rear grip; and the trigger being positioned between the rear grip and the muzzle.

4. The firearm with a rotating pistol as claimed in claim 3 comprises, the first trigger being collinear with the second trigger; and the electronic trigger being attached to the first trigger.

5. The firearm with a rotating pistol as claimed in claim 1 comprises, the set of accessories comprises a strap, a magazine, a control panel, a scope, and a primary camera;

the first display being positioned beside and rotatably connected to the primary firearm;

the second display being recessed into the primary firearm opposite the first display;

the primary camera being connected to primary firearm below the muzzle;

the scope being connected atop the receiver;

the control panel being recessed into the primary firearm;

the primary camera being communitively coupled to the first display, the second display, the control panel, and the communications module;

the control panel being communitively coupled to the first display and the second display; and the battery being electrically connected to the control panel, the primary camera, the first display, the second display, and the communications module.

6. The firearm with a rotating pistol as claimed in claim 5 comprises, the magazine traversing into the forend between the primary barrel and the rear grip;

the magazine being connected to the receiver;

the strap being connected to the telescoping shoulder rest; and the battery being housed in the primary firearm.

7. The firearm with a rotating pistol as claimed in claim 1 comprises, the secondary firearm further comprises a secondary camera and a cocking rod;

the secondary barrel being parallel to the primary barrel;

the secondary camera being connected to the secondary firearm below the secondary barrel;

the cocking rod being positioned adjacent to the secondary barrel;

the cocking rod being perpendicular to the secondary barrel;

the secondary camera being communitively coupled to the first display, the second display, the control panel, and the communications module; and the battery being electrically connected to the secondary camera.

8. A firearm with a rotating pistol comprises, a primary firearm;

the primary firearm comprises a receiver, a primary barrel, a trigger, a swivel control, a first mounting point, a second mounting point, a third mounting point, a first display, a second display, a stock, and a set of accessories;

the primary barrel comprises a muzzle;

the stock comprises a forend, a telescoping shoulder rest, and a rear grip, wherein the telescoping shoulder rest is padded;

the first mounting point, the second mounting point, and the third mounting point each comprise a quick-release mechanism;

a secondary firearm;

the secondary firearm comprises a secondary barrel and a secondary trigger;

a communications module;

a battery;

an electroshock weapon;

a knife;

the primary barrel being positioned atop and connected to the forend;

the secondary firearm being rotatably attached to the first mounting point;

the telescoping shoulder rest being rotatably connected to the rear grip;

the receiver being connected to the trigger and the primary barrel;

the swivel control being housed within the forend between the muzzle and the rear grip, wherein the swivel control is exposed on each side of the forend;

the first mounting point further comprises a locking mechanism;

the first mounting point being positioned below and connected to the forend adjacent to the swivel control;

the second mounting point being positioned on and connected to the primary firearm adjacent to the muzzle;

the third mounting point being positioned on and connected to the primary firearm adjacent to the second mounting point;

the set of accessories comprises a strap, a magazine, a control panel, a scope, and a primary camera; and the secondary barrel being parallel to the primary barrel.

9. The firearm with a rotating pistol as claimed in claim 8 comprises, the forend being connected to the rear grip opposite the telescoping shoulder rest; and the receiver being positioned adjacent to the primary barrel and the rear grip.

10. The firearm with a rotating pistol as claimed in claim 8 comprises, the electroshock weapon being attached to the second mounting point; and the knife being attached to the third mounting point.

11. The firearm with a rotating pistol as claimed in claim 8 comprises, the trigger comprises a first trigger, a second trigger, and an electronic trigger;

the trigger being connected to the stock adjacent to the rear grip;

the trigger being positioned between the rear grip and the muzzle;

the first trigger being collinear with the second trigger; and the electronic trigger being attached to the first trigger.

12. The firearm with a rotating pistol as claimed in claim 8 comprises, the first display being positioned beside and rotatably connected to the primary firearm;

the second display being recessed into the primary firearm opposite the first display;

the primary camera being connected to primary firearm below the muzzle;

the scope being connected atop the receiver;

the control panel being recessed into the primary firearm;

the primary camera being communitively coupled to the first display, the second display, the control panel, and the communications module;

the control panel being communitively coupled to the first display and the second display;

the battery being electrically connected to the control panel, the primary camera, the first display, the second display, and the communications module;

the magazine traversing into the forend between the primary barrel and the rear grip;

the magazine being connected to the receiver;

the strap being connected to the telescoping shoulder rest; and the battery being housed in the primary firearm.

13. The firearm with a rotating pistol as claimed in claim 8 comprises, the secondary firearm further comprises a secondary camera and a cocking rod;

the secondary camera being connected to the secondary firearm below the secondary barrel;

the cocking rod being positioned adjacent to the secondary barrel;

the cocking rod being perpendicular to the secondary barrel;

the secondary camera being communitively coupled to the first display, the second display, the control panel, and the communications module; and the battery being electrically connected to the secondary camera.

14. A firearm with a rotating pistol comprises, a primary firearm;

the primary firearm comprises a receiver, a primary barrel, a trigger, a swivel control, a first mounting point, a second mounting point, a third mounting point, a first display, a second display, a stock, and a set of accessories;

the primary barrel comprises a muzzle;

the stock comprises a forend, a telescoping shoulder rest, and a rear grip, wherein the telescoping shoulder rest is padded;

the first mounting point, the second mounting point, and the third mounting point each comprise a quick-release mechanism;

a secondary firearm;

the secondary firearm comprises a secondary barrel, a secondary trigger, and a secondary camera;

a communications module;

a battery;

an electroshock weapon;

a knife;

the primary barrel being positioned atop and connected to the forend;

the secondary firearm being rotatably attached to the first mounting point;

the telescoping shoulder rest being rotatably connected to the rear grip;

the receiver being connected to the trigger and the primary barrel;

the swivel control being housed within the forend between the muzzle and the rear grip, wherein the swivel control is exposed on each side of the forend;

the first mounting point further comprises a locking mechanism;

the first mounting point being positioned below and connected to the forend adjacent to the swivel control;

the second mounting point being positioned on and connected to the primary firearm adjacent to the muzzle;

the third mounting point being positioned on and connected to the primary firearm adjacent to the second mounting point;

the set of accessories comprises a strap, a magazine, a control panel, a scope, and a primary camera;

the secondary barrel being parallel to the primary barrel;

the electroshock weapon being attached to the second mounting point;

the knife being attached to the third mounting point;

the trigger comprises a first trigger, a second trigger, and an electronic trigger;

the primary camera being communitively coupled to the first display, the second display, the control panel, and the communications module;

the control panel being communitively coupled to the first display and the second display;

the battery being electrically connected to the control panel, the primary camera, the first display, the second display, and the communications module;

the secondary camera being communitively coupled to the first display, the second display, the control panel, and the communications module; and the battery being electrically connected to the secondary camera.

15. The firearm with a rotating pistol as claimed in claim 14 comprises, the forend being connected to the rear grip opposite the telescoping shoulder rest; and the receiver being positioned adjacent to the primary barrel and the rear grip.

16. The firearm with a rotating pistol as claimed in claim 14 comprises, the trigger being connected to the stock adjacent to the rear grip;

the trigger being positioned between the rear grip and the muzzle;

the first trigger being collinear with the second trigger; and the electronic trigger being attached to the first trigger.

17. The firearm with a rotating pistol as claimed in claim 14 comprises, the first display being positioned beside and rotatably connected to the primary firearm;

the second display being recessed into the primary firearm opposite the first display;

the primary camera being connected to primary firearm below the muzzle;

the scope being connected atop the receiver;

the control panel being recessed into the primary firearm;

the magazine traversing into the forend between the primary barrel and the rear grip;

the magazine being connected to the receiver;

the strap being connected to the telescoping shoulder rest; and the battery being housed in the primary firearm.

18. The firearm with a rotating pistol as claimed in claim 14 comprises, the secondary firearm further comprises a cocking rod;

the cocking rod being positioned adjacent to the secondary barrel;

the cocking rod being perpendicular to the secondary barrel; and the secondary camera being connected to the secondary firearm below the secondary barrel.

* * * * *